United States Patent [19]

Chapman

[11] Patent Number: 4,851,742

[45] Date of Patent: Jul. 25, 1989

[54] COMPARTMENT PANEL CONTROL APPARATUS FOR A MOTOR VEHICLE

[75] Inventor: Walter C. Chapman, Washington, Mich.

[73] Assignee: General Motors Corporation, Detroit, Mich.

[21] Appl. No.: 301,775

[22] Filed: Jan. 26, 1989

[51] Int. Cl.[4] ..... E05F 15/10; E05B 47/00

[52] U.S. Cl. ..... 318/286; 318/466; 49/280; 292/341.16; 292/201

[58] Field of Search ..... 318/286, 452, 453, 454, 318/455, 466, 469, 476; 49/280; 292/201, 341.16, DIG. 42, DIG. 43; 70/240, 241, 279; 307/9, 10 R; 296/76

[56] References Cited

U.S. PATENT DOCUMENTS

| | | | |
|---|---|---|---|
| 4,322,959 | 4/1982 | Mochida | 70/241 |
| 4,333,269 | 6/1982 | Bascou | 49/280 |
| 4,644,693 | 2/1987 | Wang | 49/280 |
| 4,739,585 | 4/1988 | Pickles | 49/280 |
| 4,796,932 | 1/1989 | Tame | 292/341.16 X |

*Primary Examiner*—Bentsu Ro

*Attorney, Agent, or Firm*—Mark A. Navarre

[57] ABSTRACT

An integrated panel control in which both the release and pulldown mechanisms are controlled by a single operator activated switch. Initial operator activation of the switch when the panel is closed energizes the release mechanism through a latch switch which indicates that the latch bolt and striker are mechanically coupled. Initial operator activation of the switch when the panel is open activates the motor of the pulldown mechanism through the latch switch in initiate a pulldown of the panel. A second activation of the switch during the pulldown aborts the pulldown sequence by reversing the pulldown motor, freeing a spring or other device to re-open the panel. A second activation of the switch after the latch bolt and striker are mechanically coupled energizes the release mechanism through the latch switch to uncouple the latch bolt from the striker, freeing a spring or other device to open the panel.

2 Claims, 5 Drawing Sheets

COMPARTMENT PANEL CONTROL APPARATUS FOR A MOTOR VEHICLE

This invention relates to a control mechanism for a motor vehicle deck lid panel, and more particularly to a mechanism which controls both opening and closing of the panel with a single operator activated switch.

BACKGROUND OF THE INVENTION

There are two generally known operator activated mechanisms for remotely controlling the operation of a latchable motor vehicle panel such as a trunk lid. On such mechanism, referred to herein as a release mechanism, permits remote release of the latch for moving the panel to a fully open position. The other mechanism, referred to herein as a pulldown mechanism, permits remote closing and sealing of the panel. The closing function involves bringing the panel to a partially closed position to mechanically couple a panel mounted latch bolt with a vertically extended striker, while the sealing function involves bringing the panel to a fully closed position by vertical retraction of the striker. The pulldown mechanism may be implemented with a reversible motor and the release mechanism may be implemented with either a solenoid or a motor.

The pulldown mechanism referred to herein may be of the type set forth in the co-pending patent application Ser. No. 143,780, filed Jan. 14, 1988, and assigned to the assignee of the present invention. In that mechanism, a pulldown sequence is initiated by operator activation of a passenger compartment or trunk mounted panel closing switch. Successful closure of the panel is indicated when the motor current exceeds a first threshold, whereafter the motor is reversed to retract the striker and seal the panel. Completion of the sealing portion of the pulldown sequence is indicated when the motor current exceeds a second threshold, whereupon the motor is deenergized, terminating the sequence.

The release mechanism referred to herein may be of the type installed in vehicles manufactured by General Motors Corporation, and described, for example, in the Service Manual for the 1989 Cadillac Seville. In that mechanism, operator activation of a passenger compartment mounted panel opening switch energizes a solenoid coil of the mechanism to release the latch bolt, freeing a spring or other device to open the panel.

SUMMARY OF THE PRESENT INVENTION

The present invention is directed to an improved and integrated panel control in which both the release and pulldown mechanisms are controlled by a single operator activated switch. Additional switches may be connected in parallel with the single switch if alternate control locations are desired.

Initial operator activation of the switch when the panel is closed energizes the release mechanism solenoid or motor through a latch switch which indicates that the latch bolt and striker are mechanically coupled. This uncouples the latch bolt from the striker, freeing a spring or other device to open the panel.

Initial operator activation of the switch when the panel is open activates the motor of the pulldown mechanism through the latch switch which now indicates that the latch bolt and striker are uncoupled. This extends the striker and pulls the panel to the partially closed position for mechanically coupling the bolt and striker. A second activation of the switch during such closing of the panel aborts the pulldown sequence by reversing the pulldown motor, freeing a spring or other device to re-open the panel.

Once the latch bolt and striker are mechanically coupled, the motor of the pulldown mechanism is reversed to retract the striker and seal the panel. A second activation of the switch during such sealing of the panel aborts the pulldown sequence by energizing the release mechanism solenoid or motor through the latch switch which again indicates that the latch bolt and striker are mechanically coupled. This uncouples the latch bolt from the striker, freeing a spring or other device to open the panel.

BRIEF DESCRIPTION OF THE DRAWINGS

FIG. 2 is a side elevation view of the motorized drive unit; FIG. 3 is a sectional view taken in the direction of arrows 3—3 of FIG. 2; FIG. 4 is a sectional view taken in the direction of arrows 4—4 of FIG. 1; and FIG. 5 is an elevation view in the direction of arrows 5—5 of FIG. 4.

Figure 1:
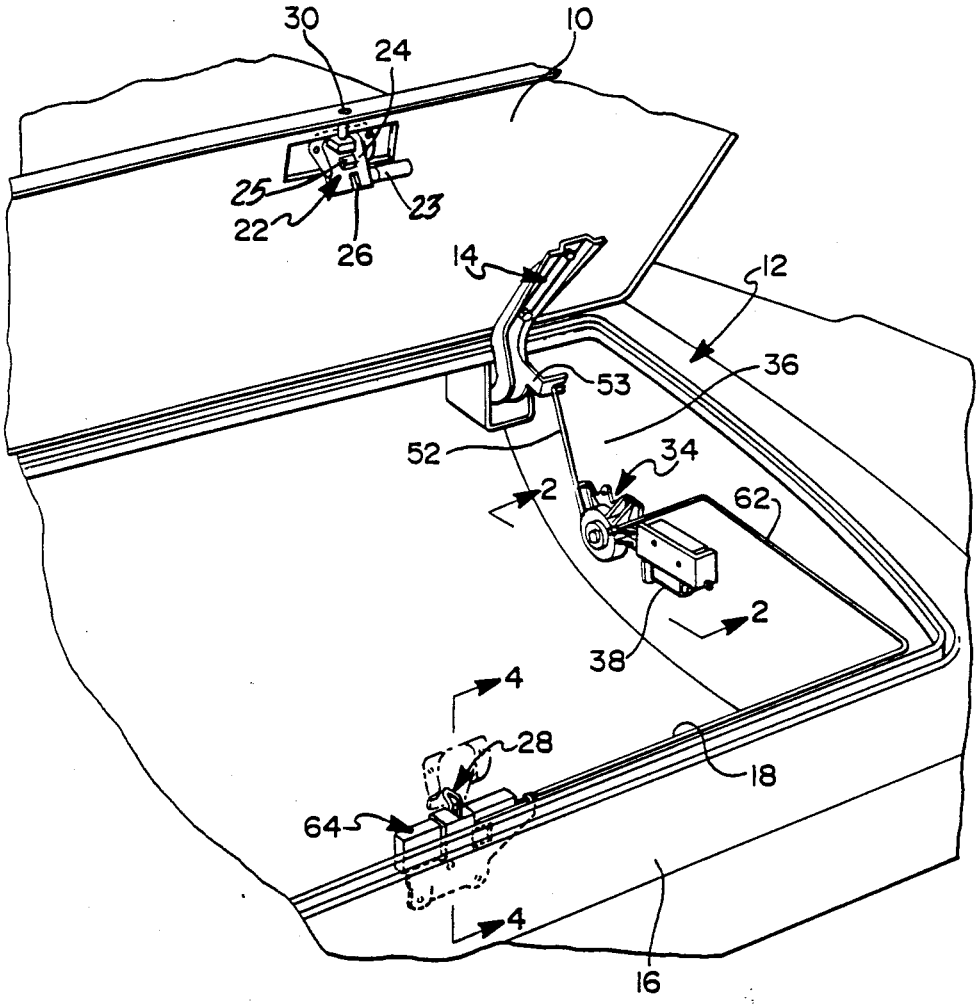
FIG. 1 is a perspective view of a vehicle body compartment, including a motorized pulldown mechanism and a control unit according to this invention.

FIG. *6a–6b* depict a circuit diagram of the control unit depicted in FIG. 1.

Figure 7:
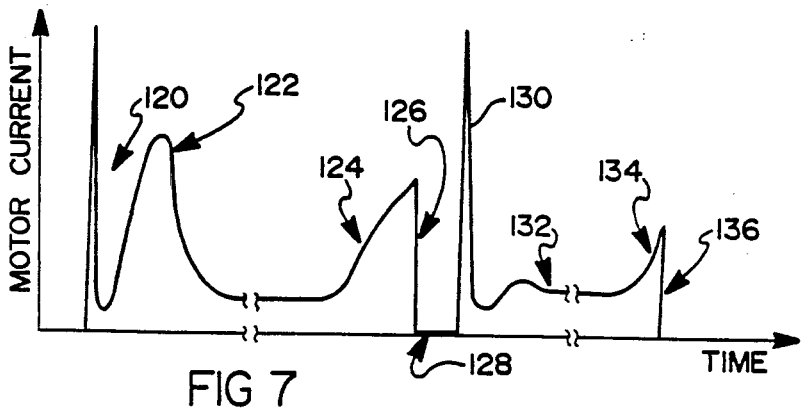

FIG. 7 graphically depicts the electrical current supplied to the motorized drive unit of FIG. 1 in the course of a typical pulldown sequence.

DESCRIPTION OF THE PREFERRED EMBODIMENT

Referring to FIG. 1, a deck lid panel 10 is mounted on a vehicle body 12 by a pair of hinges, one of which is shown at 14. Body panel 16 of the vehicle body 12 defines a compartment opening 18 which is opened and closed by the deck lid panel 10. A spring, not shown, urges the panel 10 to the open position shown in FIG. 1.

The panel 10 may be latched in a closed position by a latch assembly, generally indicated at 22, which is mounted on the compartment panel 10. The latch assembly 22 includes a housing 24 having a latch bolt 26 pivotally mounted thereon. The latch bolt 26 is adapted to mechanically couple with a striker 28 carried by the body panel 16, to thereby latch and interconnect panel 10 with the body panel 16. A latch switch 25 is mounted on the latch assembly 22 and provides an electrical indication as to whether the latch bolt 26 and striker 28 are mechanically coupled. Such indication is used in the control of panel 10 as described below.

The latch assembly 22 includes a latch bolt spring, not shown, which biases the latch bolt 26 to an unlatched position. When panel 10 is moved toward a closed position, the latch bolt 26 engages the striker 28 and is thereby pivoted to a latching position with respect to striker 28. The latch assembly 22 includes a detent lever, not shown, which maintains the latch bolt in the latched position with respect to the striker 28.

The latch assembly 22 also includes a key operated lock cylinder 30 which is rotatable when a properly bitted key is inserted. Rotation of the key cylinder pivots the detent lever out of engagement with the latch bolt 26 and permits the latch bolt spring to return the latch bolt to its unlatched position, thereby disconnecting the latch assembly 22 from the striker 28 and enabling the panel 10 to be moved to its open position by the compartment panel spring.

A similar function is performed by the conventional solenoid operated release mechanism 23, which is mounted on the latch assembly 22 with respect to the latch bolt 26. When the latch bolt 26 and striker 28 are mechanically coupled, the release mechanism 23 may be energized to activate the above-mentioned detent lever for uncoupling the latch bolt 26 from the striker 28.

Figure 2:
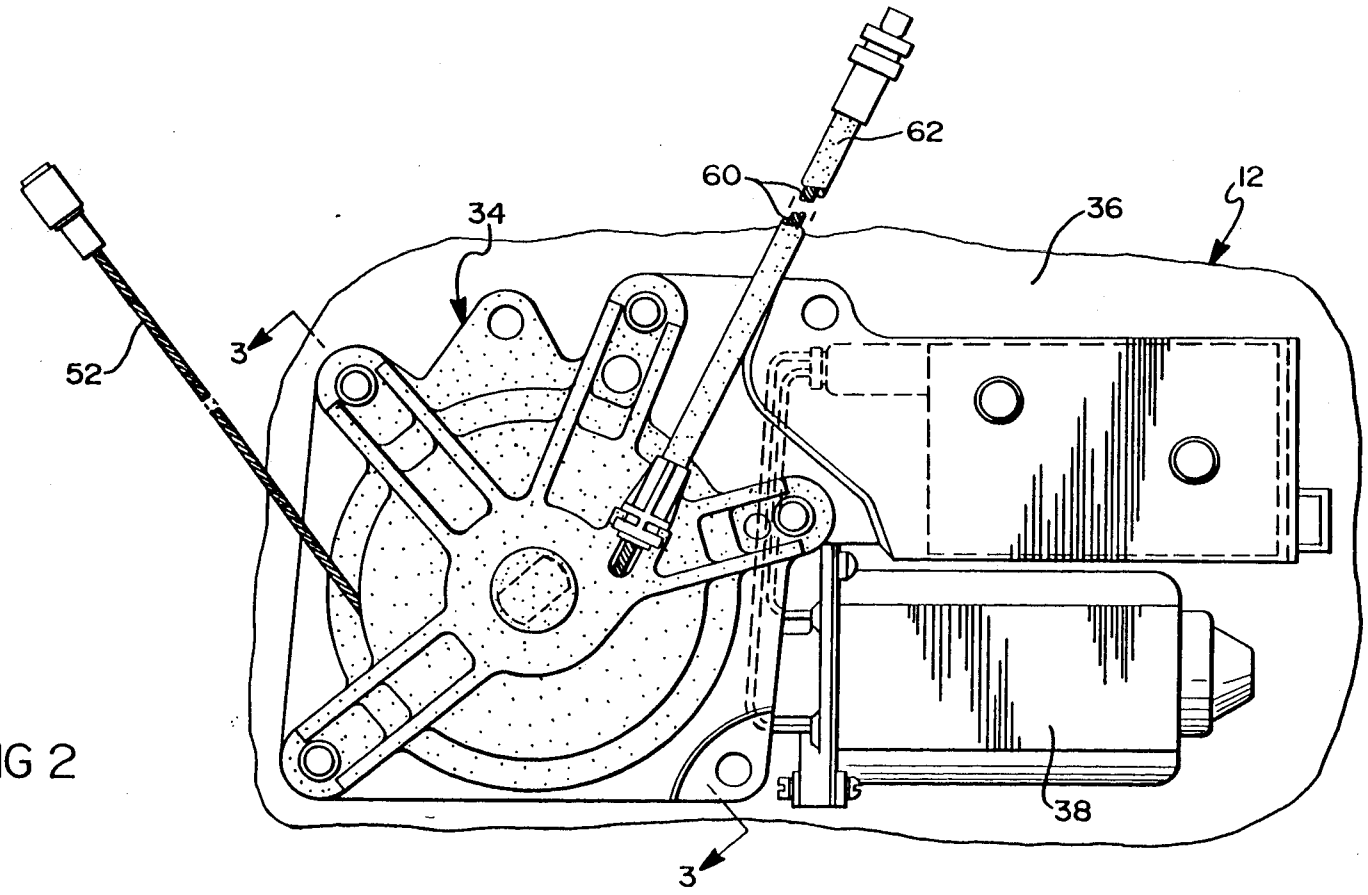
FIGS. 2–5 depict further views of the pulldown mechanism of FIG. 1.

Referring again to FIG. 1, a motorized drive unit 34 is provided to pulldown panel 10 to latch the latch assembly 22 with the striker 28 and to also pull down the striker 28 to seal the compartment panel 10 at its fully closed position. As best seen in FIG. 2, motorized pulldown unit 34 is mounted on the side wall structure 36 of the vehicle body 12 and includes a motor 38 which reversibly rotates a cable drum 40, best shown in FIG. 3. The cable drum 40 is rotatably mounted inside a housing 42 by a shaft 44. A drive pinion 46 is connected to the motor 38 by a suitable gear transmission and meshes with teeth 48 provided on the inside of cable drum 40.

Figure 3:
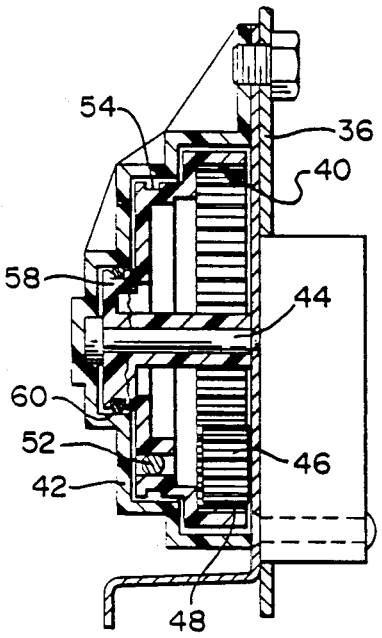

As seen in FIGS. 1, 2 and 3, a cable 52 is connected to an offset arm 54 of the panel hinge 14 and wraps around a pulley 54 of the cable drum 40. The innermost end of the cable 52 is anchored on the drum 40 so that rotation of the drum winds the cable 52. In particular, counterclockwise rotation of the drum 40, as viewed in FIG. 2, winds up the cable 52 and pulls the panel 10 down toward the closed position to perform the closing function.

The motorized drive unit also includes a second pulley 58 of the drum 40 which has a cable 60 attached thereto. As best seen by reference to FIG. 2, the cable 60 is wrapped around the drum 40 in the opposite direction of the cable 52 so that drum rotation in the direction to wind and retract cable 52 will extend the cable 60. The cable 60 is routed through a sheath 62 which extends to a pulldown mechanism 64 for the striker 28.

Figure 4:
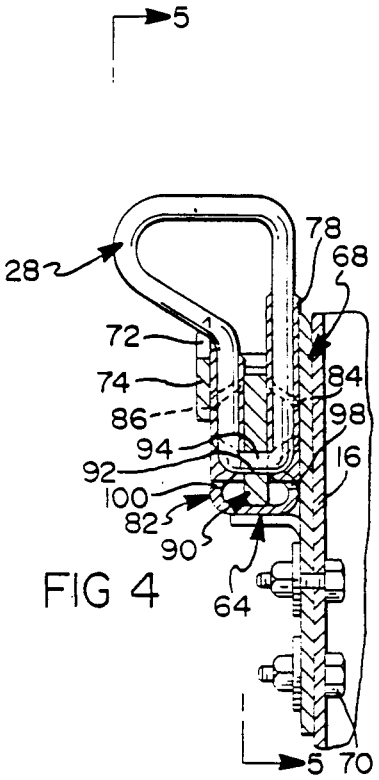
Figure 5:
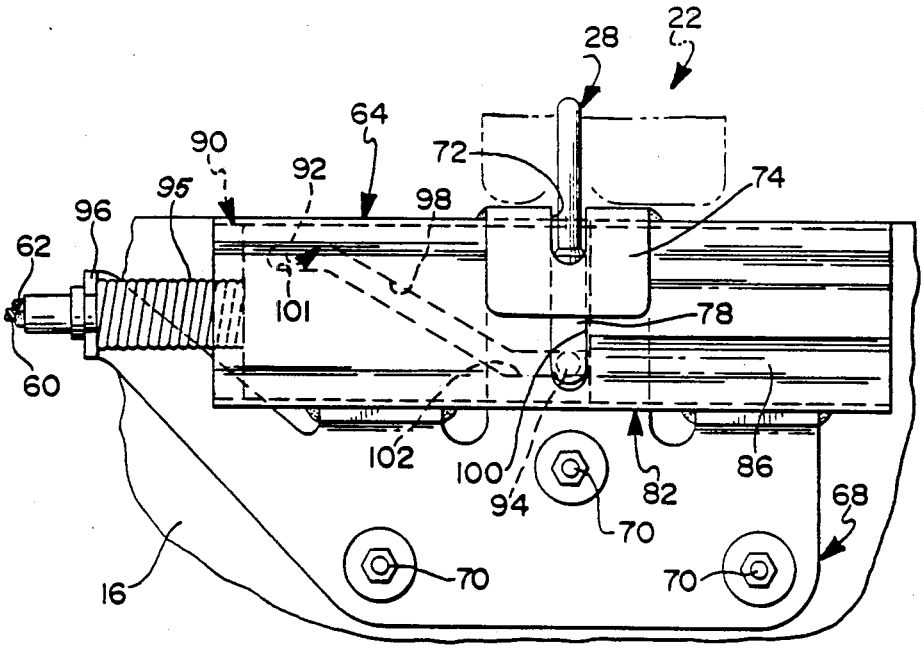

The pulldown mechanism 64 for the striker 28 is shown in FIGS. 1, 4 and 5. The pulldown mechanism includes a housing 68 bolted to the body panel 16. The striker 28 is defined by a bent rod and is captured within a slot 72 defined in a flange portion 74 of the housing 68. The bottom most portion of the striker 28 is encapsulated in the shoe 78 which is slidably captured between the housing 68 and flange 74 to mount the striker 28 for up and down movement. A U-shaped track 82 is mounted on the housing 68 and has upstanding legs 84 an 86 which slidably capture a slide member 90. As best seen in FIG. 5, the slide member 90 has a cam slot 92 therein which receives the lowermost leg 94 of the striker 28, thereby defining a cam follower which rides in the cam slot 92 of the slide member 90. The upstanding legs 84 and 86 of the U-shaped track 82 respectively have vertical extending slots 98 and 100 which receive the striker shoe 78 to further define the path of vertical up and down movement of the striker 28.

As best seen in FIG. 5, the cable 60 is attached to the slide member 90 so that clockwise rotation of the drum 40, as viewed in FIG. 2, will retract the cable 60 and pull the slide member 90 leftwardly, as viewed in FIG. 5. A coil compression spring 94 has one end seated against the slide member 90 and the other end seated against a stop 96 of the housing 68 to urge the slide member 90 rightwardly as viewed in FIG. 5.

The cam slot 92 includes a central inclined portion 98, a horizontal dwell portion 100 at the upper end of the inclined portion 98 and a horizontal dwell portion 102 at the lower end of the inclined portion 98. The coil compression spring 94 normally positions the slide member 90 at the rightward position at which the dwell portion 100 of the cam slot 92 establishes the striker 28 at its upwardly extended position of FIGS. 1 and 5.

Figure 6A:
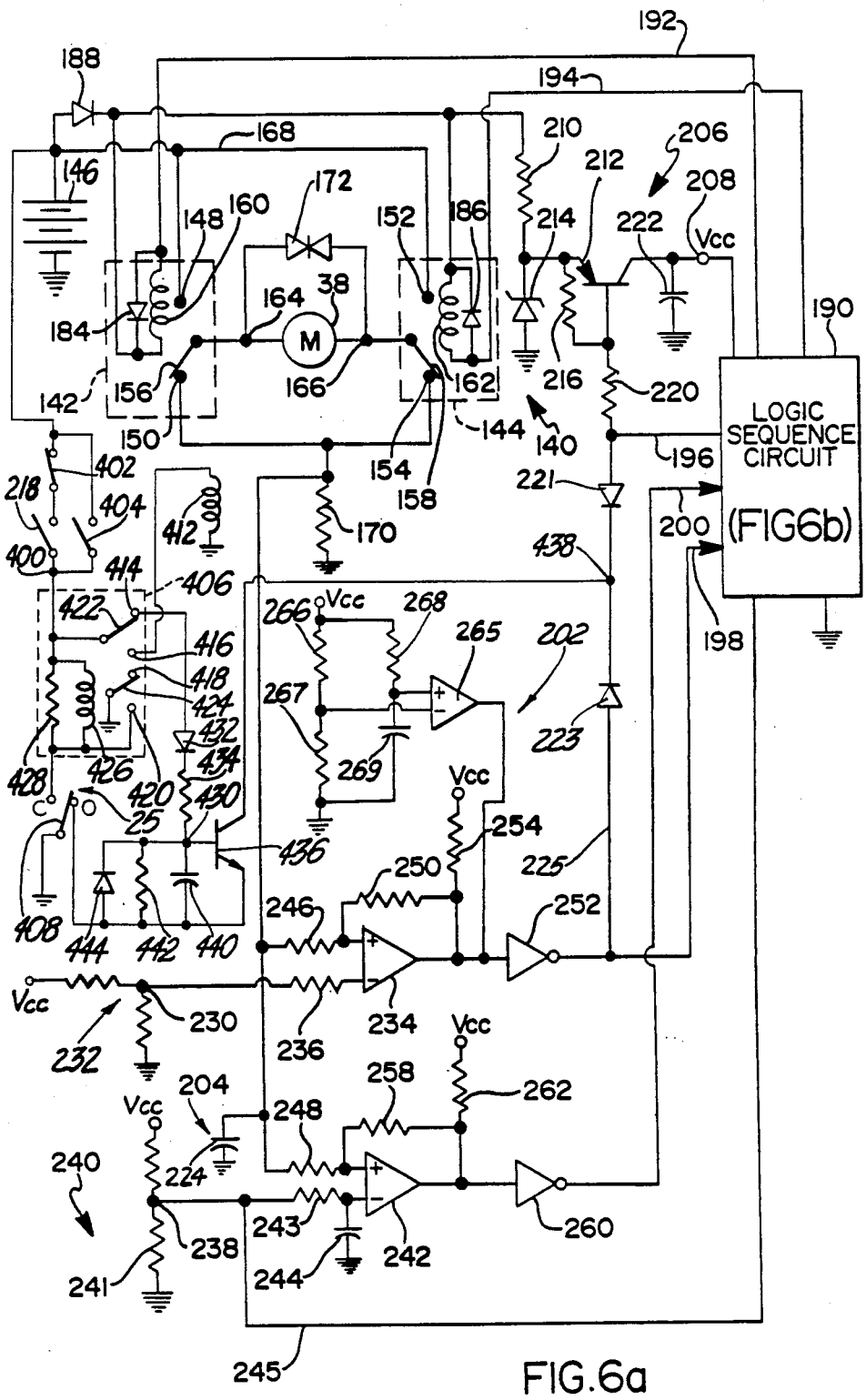
Figure 6B:
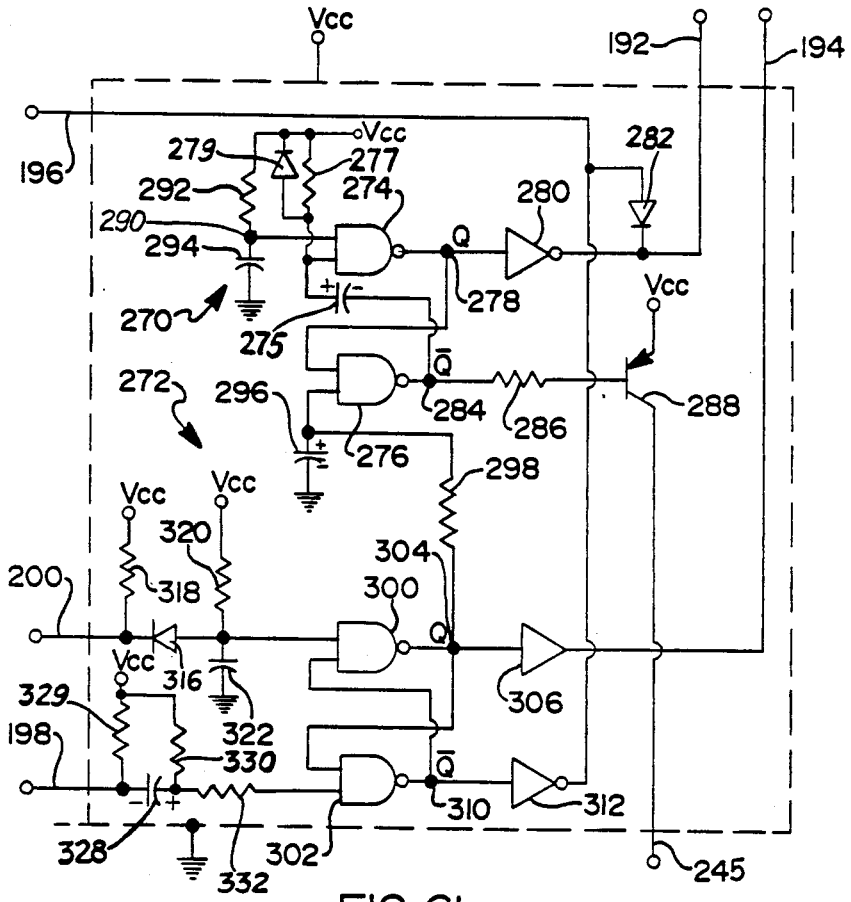

When a driver operated switch, schematically illustrated in FIG. 6*a* by the reference numeral 218, is momentarily depressed with the panel 10 in the closed position, the control circuit of FIGS. 6*a* and 6*b* energizes the release mechanism solenoid coil through the latch switch 25, which electrically indicates that the latch bolt 26 and striker 28 are coupled. As a result, the release mechanism 23 uncouples the latch bolt 26 from the striker 28, freeing the panel spring to open the panel 10.

If the operator depresses the switch 218 with the panel 10 open, the latch switch 25 indicates that the latch bolt 26 and striker 28 are uncoupled and the motor 38 is energized to rotate the drum 40 in a counterclockwise direction. This causes a momentary inrush of current to motor 38, as indicated by the reference numeral 120 in FIG. 7, which falls sharply as the motor 38 begins to rotate. As the motor 38 begins rotating, the drum 40 begins retracting cable 52 to initiate closure of the deck lid panel 10 and extending cable 60 to initiate vertical extension of the striker 28. During this load pickup phase, the motor current rises as indicated by the reference numeral 122 in FIG. 7, falling to a relatively steady level as the motor speed increases and stabilizes.

A second depression of the switch 218 during the panel closing phase aborts the pulldown sequence by energizing motor 38 to rotate drum 40 in a clockwise direction. This extends cable 52, freeing the panel spring to re-open panel 10.

When the closing movement of the deck lid panel 10 carries the latch assembly 22 into engagement with the striker 28, the latch bolt 26 is rotated into latching engagement with the striker 28, thereby coupling the panel 10 with the striker 28. This significantly increases the mechanical load and produces a sharp rise in the motor current, as indicated by the reference numeral 124 in FIG. 7. As described below in reference to FIGS. 6*a*–6*b* the control unit of this invention detects the increased current associated with the latching and interrupts the motor current as indicated by the reference numeral 126 in FIG. 7.

After a brief pause, indicated by the reference numeral 128 in FIG. 7, the control unit energizes motor 38 in the clockwise direction to reverse the direction of rotation of the drum 40. This causes a second momentary inrush of current to motor 38, as indicated by the reference numeral 130 in FIG. 7, which falls sharply as the motor 38 begins to rotate. As the motor 38 begins rotating, the cable 52 goes slack, and the drum 40 begins retracting cable 60 to initiate vertical retraction of the striker 28 for sealing the panel 10 against the panel 16. The motor current rises with the load pickup as indicated by the reference numeral 132 in FIG. 7, thereafter falling to a relatively steady level as the motor speed stabilizes.

A second depression of the switch 218 during the panel sealing phase aborts the pulldown sequence by energizing release mechanism 23 through the latch switch 25 which again indicates that the latch bolt 26 and striker 28 are mechanically coupled. This uncouples the latch bolt 26 from the striker 28, freeing the panel spring to re-open panel 10.

When the slide member 90 reaches the full leftward position of FIG. 5, the dwell portion 102 of the cam slot 92 is engaged with the cam follower portion 94 of striker 28. At the end of such travel, the mechanical load reflected to motor 38 significantly increases, resulting in a sharp rise in the motor current, as indicated by the reference numeral 134 in FIG. 7. As described below in reference to FIGS. 6a–6b, the control unit of this invention detects such increased current and interrupts the motor current as indicated by the reference numeral 136.

A control unit for carrying out the control of this invention is schematically depicted in FIGS. 6a and 6b. FIG. 6a depicts the overall circuit and FIG. 6b depicts a functional block of FIG. 6a in greater detail.

Referring particularly to FIG. 6a, the reference numeral 140 generally designates a relay switching circuit connected to the motor terminals 164 and 166. The switching circuit 140 comprises a pair of single-pole double-throw relays 142, 144 controllable to bi-directionally energize the motor 38 with direct current from a conventional automotive storage battery 146. The relays 142, 144 each comprise a pair of contacts 148, 150; 152, 154, a switch arm 156, 158 spring biased to engage the lower contact 150, 154 as shown in FIG. 6a, and a coil 160, 162 energizeable to overcome the spring bias, moving the switch arm 156, 158 into engagement with the upper contact 148, 152.

The switch arm 156 of relay 142 is connected to the motor terminal 164, and the switch arm 158 of relay 144 is connected to the motor terminal 166. The upper relay contacts 148 and 152 are connected to the positive terminal of battery 146 via line 168. The lower relay contacts 150 and 154 are connected to ground potential and the negative terminal of battery 146 via the current shunt resistor 170.

In the normal, or rest condition, the relays 142 and 144 connect both motor terminals 164 and 166 to ground potential via shunt resistor 170. When counterclockwise rotation of the motor 38 is required, the relay coil 160 is energized to bring switch arm 156 into engagement with the upper relay contact 148. This completes a first motor energization circuit comprising battery 146, relay contacts 148 and 154, and the shunt resistor 170. When clockwise rotation of the motor 38 is required, the relay coil 162 is energized to bring switch arm 158 into engagement with the upper relay contact 152. This completes a second motor energization circuit comprising battery 146, relay contacts 152 and 150, and the shunt resistor 170.

Upon deenergization of either relay coil 160 or 162, the motor 38 is momentarily open-circuited, and the MOV 172 suppresses high voltage transients associated with the collapse of the motor field energy. When the respective switch arm 156, 158 reaches its rest position, the motor terminals 164 and 166 are short-circuited, and the inductive energy is circulated through the motor winding.

One terminal of each relay coil 160, 162 is connected to the positive terminal of battery 146 through the diode 188. The other terminals of relay coils 160 and 162 are connected to the LOGIC SEQUENCE CIRCUIT 190 via lines 192 and 194, which circuit selectively connects the lines 192 and 194 to ground potential for energizing the respective relay coils 160 and 162. In performing such control, the LOGIC SEQUENCE CIRCUIT 190 is responsive to a momentary grounding of line 196 and to the motor current limit signals on lines 198 and 200. The current limit signals on lines 198 and 200 are developed by the closing detection circuit 202 and the sealing detection circuit 204, respectively. The LOGIC SEQUENCE CIRCUIT 190 is shown in detail in FIG. 6b.

Operating voltage for the LOGIC SEQUENCE CIRCUIT 190 and the closing and sealing detection circuits 202 and 204, designated Vcc, is supplied by battery 146 via the wake-up circuit 206 at the junction 208. The junction 208 is connected to battery 146 via diode 188, resistor 210 and the emitter-collector circuit of transistor 212. The Zener diode 214 protects the transistor 212 from overvoltage transients and the resistor 216 biases transistor 212 to a normally nonconductive state.

The switch 218 is mounted in the passenger compartment of the vehicle and is adapted to be momentarily depressed by the operator of the vehicle when it is desired to initiate opening or closing of the panel 10. When depressed, the switch connects the positive terminal voltage of battery 146 to terminal 400 through a conventional ignition switch 402. If desired, opening or closing of the panel may also be initiated by momentary depression of an alternate switch 404 connected directly between terminal 400 and battery 146. If desired, the switch 404 could be mounted in the trunk of the vehicle for operator activation to initiate closing of the panel 10. Alternately, the switch 404 could represent the contacts of a relay remotely controlled by a keyless entry transceiver.

The reference numeral 406 designates a double-pole double-throw relay comprising two pairs of contacts 414, 416; 418, 420, a pair of switch arms 422, 424 spring biased to engage the respective upper contacts 414, 418 as shown in FIG. 6a, and a coil 426 energizeable to overcome the spring bias, moving the switch arms 422, 424 into engagement with the lower contacts 416, 420, respectively. The resistor 428 is connected in parallel with coil 426 and operates to dissipate inductive energy stored in the coil 426 at its deenergization.

The coil 426 of relay 406 is energizable by closure of the switches 218 or 404 when the switch arm 408 of latch switch 25 is in the "panel closed" position (C). In such case, the switch arm 422 connects terminal 400 to the ungrounded terminal of the release mechanism solenoid coil 412 and switch arm 424 connects the contact 420 to ground potential. This serves to maintain the coil energization so long as the switch 218 or 404 is depressed, and to activate the release mechanism 23 to uncouple the latch bolt 26 from the striker 28 as described above, freeing the panel spring to open panel 10.

When the switch arm 408 of latch switch 25 is in the "panel open" position (O), activation of the switches 218 or 404 does not energize the relay coil 428; instead, the terminal 400 is connected to the terminal 430 via relay switch arm 422, relay contact 414, diode 432 and resistor 434. The terminal 430 is connected to the base terminal of transistor 436 so that activation of the switches 218 or 404 connects the terminal 438 to ground potential through the emitter-collector circuit of transistor 436 and the switch arm 408 of latch switch 25. As described above, this initiates closure and sealing of the panel 10. The capacitor 440 and diode 444 operate as shunts for transient voltages and the resistor 442 maintains the transistor 436 in a normally nonconductive state.

The terminal 438 is connected to the base of wake-up circuit transistor 212 via resistor 220 and diode 221 to thereby bias transistor 212 conductive to develop the operating voltage Vcc at junction 208 when switches 218 or 404 are depressed. As described below in reference to FIG. 6*b*, the LOGIC SEQUENCE CIRCUIT 190 senses the initial turn on of the operating voltage $V_{cc}$, and operates at such point to latch the transistor 212 in a conductive state by maintaining line 196 substantially at ground potential.

When the pulldown sequence is completed, as indicated by the sealing detection circuit 204, the LOGIC SEQUENCE CIRCUIT 190 removes the bias, and the wake-up circuit transistor 212 returns to its normally nonconductive state. Filter capacitor 222 prevents an abrupt loss of the operating voltage Vcc during the latching operation and at the end of the pulldown sequence. The line 225 provides a path between switch 218 and closing detection circuit 202 for driver commanded reversal of the pulldown sequence as explained below. The diodes 221 and 223 mutually isolate the line 196 and the closing detection circuit 202.

A voltage reference corresponding to a motor current of approximately 10 amperes (A) is generated at junction 230 by the voltage divider 232 and is supplied to the inverting input of closing detection circuit comparator 234 via resistor 236. A voltage reference corresponding to a motor current of approximately 5 A is generated at junction 238 by the voltage divider 240, and is supplied to the inverting input of sealing detection circuit comparator 242 via an RC timing circuit comprising the resistor 243 and the capacitor 244. In each case, the voltage reference is compared with the actual motor current as deduced by the voltage across shunt resistor 170, such voltage being supplied to the noninverting inputs of comparators 234 and 242 via resistors 246 and 248, respectively. The capacitor 224 acts as a shunt for any high voltage transients. As described below in reference to FIG. 6*b*, the reference voltage developed by divider 240 is subject to being overridden by the LOGIC SEQUENCE CIRCUIT 190 during the closing portion of the pulldown sequence via the line 245.

The sealing detection circuit 204 further includes a feedback resistor 258, a pull-up resistor 262 and an inverter 260 connecting comparator 242 to the output line 200. When the actual motor current is lower than the 5 A reference defined by the divider 240, the comparator output is at a low potential and inverter 260 drives the output line 200 to a high potential. When the actual motor current exceeds the 5 A reference, the comparator output is high, and inverter 260 drives the output line 200 low to signal that the 5 A reference has been exceeded. Capacitor 244 forms an RC timing circuit with resistor 243 for maintaining the comparator output low during the current in-rush and load pick-up phases of the panel sealing.

The closing detection circuit 202 further includes a feedback resistor 250, a pull-up resistor 254 and an inverter 252 connecting comparator 234 to the output line 198. When the actual motor current is lower than the 10 A reference defined by the divider 232, the comparator output is at a logic zero potential (low), and inverter 252 drives the output line 198 to a logic one potential (high). When the actual motor current exceeds the 10 A reference, the comparator output is high and inverter 252 drives the output line 198 low to signal that the 10 A reference has been exceeded.

Upon initial application of the operating voltage Vcc and for a predetermined delay period thereafter, the output of comparator 234 is maintained at a low potential by the comparator 265. The capacitor 269 charges through the resistor 268, and the divider resistors 266 and 267 provide a reference with which the capacitor voltage is compared. When the capacitor voltage exceeds the reference voltage, the comparator 265 releases the output of comparator 234. As described below, this delay effectively disables the closing detection circuit 202 during the initial motor current inrush and load pick up phases of the closing portion of the pulldown sequence.

Referring now to FIG. 6*b* and the LOGIC SEQUENCE CIRCUIT 190, control of the relay coil energization is performed by a pair of logical flip-flop circuits, designated by the reference numerals 270 and 272. Flip-flop circuit 270 energizes the relay coil 160 and overrides the 5 A sealing current reference when the operating voltage Vcc is initially supplied to begin the closing portion of the pulldown sequence. Flip-flop circuit 272 is responsive to the current limit signals on output lines 198 and 200 for terminating the closing portion of the sequence and controlling activation of the sealing portion.

The flip-flop circuit 270 comprises a pair of cross-coupled NAND-gates 274 and 276. The Q output at junction 278 is connected to the output line 192 via inverter 280 for controlling the energization of closing relay coil 160. The diode 282 connects the output of inverter 280 to the line 196 for latching the wake-up circuit 206 during the energization of relay coil 160. The Q-bar output at junction 284 is connected via resistor 286 to the base transistor 288, which operates when conductive to disable the sealing detection circuit reference by increasing it from 5 A to a value in excess of the closing reference of 10 A.

The junction 290 of an RC timing circuit comprising the resistor 292 and the capacitor 294 is connected as an input to NAND-gate 274 for ensuring an initial condition of the NAND-gates 274 and 276 for performing the above-described functions on initial application of the operating voltage Vcc. The resistor 277 and diode 279 cooperate with the capacitor 275 to deenergize the relay coil 160 if the motor current fails to reach the closing current reference within a predetermined interval, as explained below. An RC timing circuit comprising the capacitor 296 and the resistor 298 couple the flip-flop circuits 270 and 272 as explained below to provide a controlled pause between the closing and sealing portions of the pulldown sequence.

The flip-flop circuit 272 also comprises a pair of cross-coupled NAND-gates 300 and 302. The Q output at junction 304 is connected to the output line 194 via buffer amplifier 306 for controlling the energization of sealing relay coil 162 and also to the NAND-gate 276 via resistor 298 and capacitor 296 for controlling the transition between the closing and sealing portions of the pulldown sequence. The Q-bar output at junction 310 is connected as an input to inverter 312, which provides a latching signal for wake-up circuit 206 on line 196 during the energization of relay coil 162.

The operation of flip-flop circuit 272 is controlled by the sealing and closing current limit signals on output lines 200 and 198. The line 200 is connected as an input to NAND-gate 300 via diode 316, the pull-up resistor 318 providing a normally high input level. An RC timing circuit comprising the resistor 320 and the capacitor 322 ensures an initial set condition of flip-flop 272 upon initial application of the operating voltage $V_{cc}$, regardless of the state of sealing detection circuit 204. The line 198 is connected as an input to the NAND-gate 302 through capacitor 328 and resistor 332. The resistors 329 and 330 cooperate with the capacitor 328 to debounce the switches 218 and 404 as explained below.

The operation of the control circuit of this invention will now be described, assuming that the panel 10 is open. In such case, the latch switch 25 is in the position shown in FIG. 6a, and momentary closure of the switches 218 or 404 biases the transistor 436 conductive. This biases wake-up circuit transistor 212 conductive to develop operating voltage Vcc at junction 208. At such point, the Q outputs of flip-flop circuits 270 and 272 both assume a high potential, thereby (1) latching transistor 212 conductive via inverter 282, (2) energizing closing relay coil 160 via inverter 280, (3) overriding the sealing current reference via transistor 288, and (4) charging the capacitor 296 to the indicated polarity. Under such conditions, the motor 38 is energized in a direction to begin pulling the panel 10 toward the closed position. During the initial current inrush and load pickup, the comparator 234 is overridden by the comparator 265 to prevent an erroneous closing indication on line 198.

If the operator now elects to abort the closing sequence by momentarily closing the switches 218 or 404 a second time, the transistor 436 is again biased conductive, pulling line 198 abruptly to ground potential through diode 223. The negative-going voltage is coupled to the NAND-gate 302 through the capacitor 328, changing the state of the flip-flop 272. At such point, the relay coil 162 is energized through buffer 306 to deenergize the motor 38 by connecting both of its terminals 164, 166 to the positive terminal of battery 146, and the capacitor 296 begins discharging through the resistor 298. In addition, the inverter 312 keeps line 196 low to maintain the operating voltage $V_{cc}$.

When capacitor 296 is sufficiently discharged, the flip-flop circuit 270 also changes state, deenergizing the closing relay coil 160. This energizes motor 38 in a direction which allows the panel spring to return the panel 10 to a fully open position. The motor in-rush and load pick-up current are ignored due to the charge on capacitor 244, which slowly discharges through resistors 241 and 243. However, when the cable 52 is fully extended, the cam follower portion of striker 28 reaches the end of travel in cam slot 92 and the sealing detection circuit output on line 200 falls to a logic zero potential, returning flip-flop 272 to the set condition. This deenergizes the relay coil 162 and unlatches the wake-up circuit transistor 212, completing the abort sequence.

If the switches 218 and 404 remain open during the pulldown sequence, however, the deck lid panel 10 will continue closing until the striker 28 and latch bolt 26 mechanically couple. At such time, the switch arm 408 of latch switch 25 engages the (C) terminal as explained above, indicating closure of the panel 10. This removes the ground path from the emitter of transistor 436, and instead, establishes a ground path for the relay 406.

When the latch bolt 26 and striker 2 mechanically couple, the increased load produces a rise in the motor current rises as designated by the reference numeral 124 in FIG. 7. when the motor current exceeds the closing detection circuit reference of 10 A, the output of inverter 252 on feedback line 198 goes low, reversing the output state of flip-flop circuit 272. At such time, the sealing relay coil 162 is energized through buffer amplifier 306, an capacitor 296 begins discharging through the resistor 298 as described above in reference to a second actuation of the switches 218 or 404. However, in this case the vertical retraction of the striker 28 pulls the panel 10 toward the sealed position.

If the control circuit is operated with the battery 146 in a near-discharged condition or the cable 52 becomes disconnected from motor 38, the 10 A closing reference defined by the divider 232 may never be exceeded. In such event, the capacitor 275 will become sufficiently charged through resistor 277 to independently change the state of the flip-flop circuit 270. If the striker 28 and latch bolt 26 are coupled, the sealing portion of the sequence will ensue; if not, the panel 10 will return to the fully open position as described above in reference to the abort function. In a mechanization of the illustrated circuit, an RC time constant of approximately 10 seconds was found to be satisfactory.

As indicated above, the sealing detection circuit output on line 200 is maintained high by the capacitor 244 during the current in-rush and load pick-up phases of the sequence, but thereafter compares the motor current with the 5 A reference defined by the divider 240. As the cam follower portion of striker 28 reaches the end of travel in cam slot 92, the motor current increases above the 5 A reference current as designated by the reference numeral 134 in FIG. 7. At such time, the comparator 242 changes state and the output of inverter 260 falls to a low potential to change the state of flip-flop circuit 272. This deenergizes the sealing relay coil 162 and unlatches the wake-up circuit transistor 212, completing the pulldown sequence.

If the switches 218 or 404 are closed following the mechanical coupling of the latch bolt 26 and striker 28 to open the panel 10, the relay coil 426 is activated through the switch arm 408. This changes the state of the switch arms 422 and 424, thereby energizing the release mechanism solenoid coil 412 to uncouple the latch bolt 26 from the striker 28 and establishing a new ground path for the coil 426, freeing the panel spring to return the panel to a fully open position. The new ground path maintains the energization of coil 426 during the closure of switches 218, 404 to prevent an undesired activation of the transistor 436 when the switch arm 408 of latch switch 25 breaks contact with its (C) terminal. Meanwhile, the retraction of striker 28 and the extension of cable 52 continue until the cable 52 is fully extended and the cam follower portion of striker 28 reaches the end of travel in cam slot 92. At this point, the motor current increases above the 5 A sealing reference current, changing the states of comparator 242 and flip-flop circuit 272 as described above, deenergizing the relay coil 162 to deenergize the motor 38.

Assuming the panel to be fully closed, operator activation of the switches 218 or 404 will energize the relay coil 426 via the switch arm 408 of latch switch 25, just as described above in reference to closure of the switches 218 or 404 during the sealing portion of the pulldown sequence. Only here, the cable is already fully extended and no energization of the pulldown motor 38 occurs.

In view of the above, it will be seen that the control circuit of this invention also provides inherent obstacle detection. If the panel 10 encounters an obstruction in the closing portion of the pulldown sequence, for example, the increased load will cause the motor current to exceed the 10 A reference defined by the divider 232. This will result in a reversal of the motor 38 just as though the striker 28 and latch bolt 26 had been coupled. Thus, the cable 52 will extend, allowing the panel to raise to its normal open position. Subsequent depression of the switches 218 or 404 will initiate a new pulldown sequence as described above.

In the manner described above, the control of this invention provides a fully integrated panel control capable of remote operation from multiple locations if desired. Although described in reference to the illustrated embodiment, the control of this invention is not limited thereto. Various modifications may occur to those skilled in the art, and it will be understood that controls incorporating such modifications may fall within the scope of this invention, which is defined by the appended claims.

The embodiments of the invention in which an exclusive property or privilege is claimed are defined as follows:

1. In a vehicle body having a compartment panel hinged for movement between open and closed positions with respect to a compartment defined by a body panel, a latch mechanism including a first element fixedly mounted on one of said panels and a second element retractably mounted on the other panel, motor operated pulldown control means effective when first activated for energizing a pulldown mechanism motor to sequentially move the compartment panel to a partially closed position of mechanically coupling between the first and second elements of said latch mechanism, and then retract the second element of said latch mechanism in the direction of such compartment panel movement to seal said panel, and a release mechanism effective when activated to uncouple the first and second elements of said latch mechanism, thereby releasing said panel to return to an open position, includes a control apparatus comprising:

single switch means adapted to be activated by a vehicle operator to control the position of said panel;

detecting means for indicating the coupled or uncoupled condition of said latch mechanism; and logic control means responsive to a first activation of said switch means (1) when said detecting means indicates that said latch mechanism is uncoupled, for activating said pulldown control means to partially close and then seal said panel, and (2) when said detecting means indicates that said latch mechanism is coupled, for activating said release mechanism to release said panel to return to an open position, whereby the operation of both of said release and pulldown mechanisms is controlled by said single switch means.

2. The vehicle body includes a control apparatus as set forth in claim 1, wherein:

the pulldown control means includes first control means for supplying forward current to said motor for moving said panel toward said partially closed position, and second control means operative upon successful mechanical coupling of said first and second elements for interrupting said forward current and supplying reverse current to said motor until such reverse current exceeds a threshold indicative of complete retraction of said second element, whereafter all motor current is interrupted; and the logic control means includes means responsive to a second activation of said switch means during the operating of said pulldown control means (1) prior to the coupling of said first and second elements of said latch mechanism, for independently initiating the operation of said second control means for returning said panel to said open position, and (2) after the coupling of said first and second elements of said latch mechanism, for activating said release mechanism to release said panel to return to an open position, thereby to abort the closing and sealing of said panel.

* * * * *